US012270545B1

(12) United States Patent
Surace

(10) Patent No.: US 12,270,545 B1
(45) Date of Patent: Apr. 8, 2025

(54) T-HEAD BOLTS OR HOLLOW FLANGED BUSHING WITH ONE THREAD OR GROOVED END IN A MULTI-LINER ARRANGEMENT

(71) Applicant: RTX Corporation, Farmington, CT (US)

(72) Inventor: Raymond Surace, Newington, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/668,829

(22) Filed: May 20, 2024

(51) Int. Cl.
*F23R 3/06* (2006.01)
*F23R 3/00* (2006.01)

(52) U.S. Cl.
CPC .... *F23R 3/002* (2013.01); *F23R 2900/03044* (2013.01)

(58) Field of Classification Search
CPC .. F23R 3/002; F23R 3/06; F23R 2900/03042; F23R 2900/03043; F23R 2900/03044
See application file for complete search history.

(56) References Cited

U.S. PATENT DOCUMENTS 7,291,407 B2 11/2007 Merrill et al.
9,903,589 B2 2/2018 Hucker et al.
10,101,029 B2 * 10/2018 Propheter-Hinckley ..... F23R 3/007
10,563,865 B2 2/2020 Chang
10,767,863 B2 9/2020 Freeman et al.
11,215,367 B2 1/2022 Kramer
2019/0264923 A1 * 8/2019 Kobayashi ..... F23R 3/42

FOREIGN PATENT DOCUMENTS

WO 2021121862 A1 6/2021

* cited by examiner

*Primary Examiner* — Steven M Sutherland
(74) *Attorney, Agent, or Firm* — Kinney & Lange, P.A.

(57) ABSTRACT

A gas turbine engine combustor panel assembly includes a shell defining an outer periphery of a combustion chamber with an outer skin with a first plurality of holes, a combustor panel including a first end, a second plurality of holes extending through an inner face to an inner void, to an outer face with a third plurality of holes to allow fluid flow from the first plurality of holes to the combustion chamber, a plurality of bolt holes, a second end with an internal combustion chamber section extending axially from a central axis and from a panel wall of the combustor panel. The assembly includes a sheet metal seal plate abutting the plurality of bolt holes and the interface, and a plurality of bolts extending along a central axis and interfacing with the plurality of bolt holes to connect the combustor panel and shell.

20 Claims, 4 Drawing Sheets

T-HEAD BOLTS OR HOLLOW FLANGED BUSHING WITH ONE THREAD OR GROOVED END IN A MULTI-LINER ARRANGEMENT

BACKGROUND

The present disclosure relates to combustor panel assemblies, and in particular panel assemblies used on a gas turbine engine.

Gas turbine combustor panel assemblies are used to insulate engine components from combustion gases, which can reach temperatures exceeding 1,600 degrees Celsius. Engines may be made more efficient by increasing the combustor inlet and exit temperatures, but cooling components and insulating other components from the combustion gases becomes more difficult. As such, combustor panels help insulate components of an engine outside of the combustion chamber from the high temperatures within.

Current combustor panels are mounted to an outer shell of the combustion chamber via mounting studs. However, mounting studs can result in localized hot spots on the combustor panels. In addition, dirt collection around the mounting studs can cause distress that results in unscheduled engine removals. A different mounting system without localized hot spots would help operate an engine at increased temperatures without adverse effects.

SUMMARY

In one example, a gas turbine engine combustor panel assembly includes a shell defining an outer periphery of a combustion chamber, the shell having an outer skin with a first plurality of holes. The assembly further includes a combustor panel including a first end including a second plurality of holes on an inner face of the combustor panel extending through the inner face to a void then to an outer face of the combustor panel with a third plurality of holes configured to allow fluid flow from the first plurality of holes to the combustion chamber, a plurality of bolt holes, and a second end comprising an internal combustion chamber section extending axially from a central axis and from a panel wall of the combustor panel. The assembly includes a sheet metal seal plate abutting the plurality of bolt holes and the interface of the combustor panel, and a plurality of bolts configured to extend along a central axis and interface with the plurality of bolt holes to connect the combustor panel to the shell.

In another example, a combustor panel arrangement for use in a combustor in a gas turbine engine includes a shell defining a combustion chamber, the shell having an outer skin with a first plurality of holes. The arrangement further includes a first combustor panel with a first end including a second plurality of holes on an inner face of the first combustor panel through to an inner void then to an outer face of the first combustor panel and configured to allow fluid flow from the first plurality of holes to the combustion chamber. The first combustor panel further includes a first plurality of bolt holes, and a second end comprising an internal combustion chamber section extending axially from a central axis and from a panel wall of the combustor panel. The assembly further includes second combustor panel with a first end including a second plurality of holes on an inner face of the second combustor panel through to an inner void then to an outer face of the second combustor panel and configured to allow fluid flow from the first plurality of holes to the combustion chamber. The second combustor panel further includes a second plurality of bolt holes, and a second end comprising an internal combustion chamber section extending axially from a central axis and from a panel wall of the combustor panel. The arrangement further includes a first plurality of bolts configured to extend along a central axis and interface with the first plurality of bolt holes to connect the first combustor panel to the shell, and a second plurality of bolts configured to extend along a central axis and interface with the second plurality of bolt holes to connect the second combustor panel to the shell, wherein the panel wall of the first combustor panel and the panel wall of the second combustor panel abut to each other.

Figure 1:
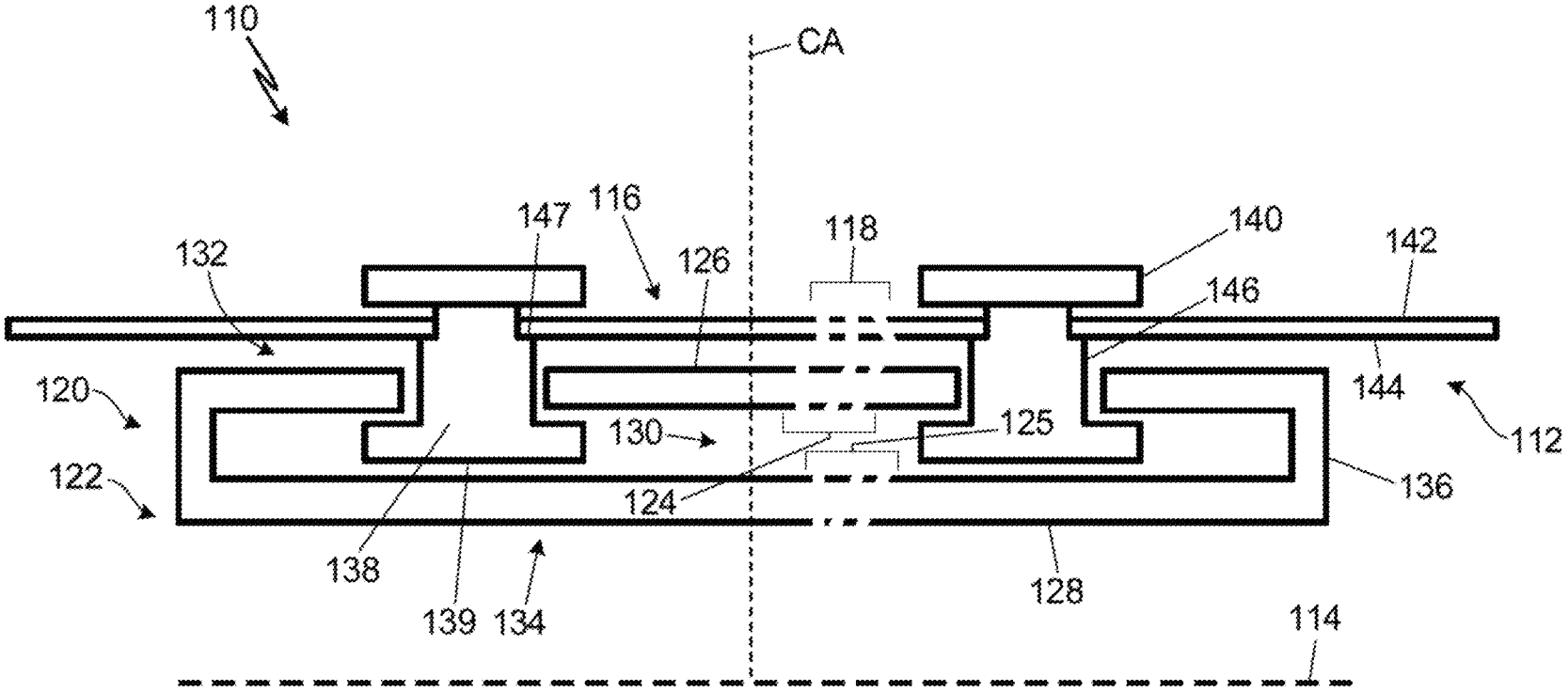
FIG. 1 is a cross-sectional view of a gas turbine engine combustor panel assembly with an inner void area.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

This disclosure presents a combustor panel assembly designed for use in a gas turbine engine. In particular, this disclosure involves attaching combustor panels to an outer skin of a combustion chamber via bolted attachments.

Figure 2:
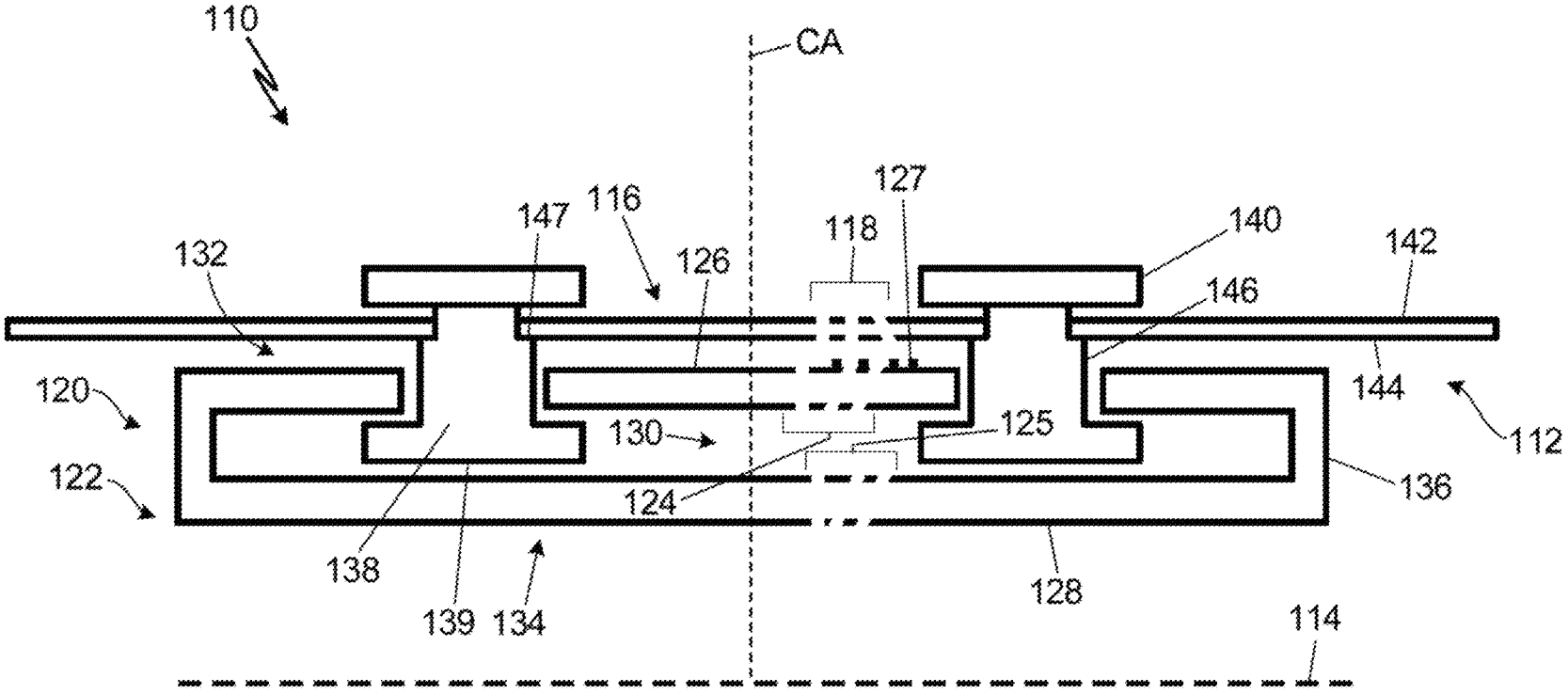
FIG. 2 is a cross-sectional view of a gas turbine engine combustor panel assembly with raised elements.

FIG. 1 is a cross-sectional view of a gas turbine engine combustor panel assembly with an inner void area. FIG. 2 is a cross-sectional view of a gas turbine engine combustor panel assembly with raised elements. FIGS. 1-2 will be discussed together.

Assembly 110 includes shell 112, which defines the outer boundary of combustion chamber 114. Shell 112 includes outer skin 116 with a first plurality of holes 118, and combustor panel 120. The combustor panel 120 includes a first end 122, a second plurality of holes 124, inner face 126, outer face 128, inner void 130, second end 132 with third plurality of holes 125, internal combustion chamber section 134 along outer face 128, and panel wall 136. Assembly 110 further includes plurality of bolts 138 with straight body section 146 and bolt shoulder 147, fasteners 140, outer face 142 of outer skin 116 and inner face 144 of outer skin 116. Inner void 130 is a space defined by inner face 126, outer face 128 and plurality of bolts 138. Assembly 110 is configured to be installed in a gas turbine engine combustor.

As discussed above, shell 112 includes outer skin 116, with first plurality of holes 118 that extend through outer skin 116 to create a flow path that continues to the second plurality of holes 124 in the first end 122 of the combustor panel 120. The second plurality of holes 124 extend through inner face 126 of combustor panel 120 to inner void 130 of combustor panel 120, which extends to outer face 128 of combustor panel 120 and third plurality of holes 125 such that fluid may flow through first plurality of holes 118 into second plurality of holes 124 of combustor panel 120, then through inner void 130, then into third plurality of holes 125 into combustion chamber 114. In FIG. 2, raised elements 127 are included on inner face 126. These raised elements help direct fluid flow into second plurality of holes 124 from first plurality of holes 118, and can also catch debris from fluid streams entering assembly 110. Combustor panel 120 can include second end 132 of combustor panel 120, which can include internal combustion chamber section 134 of second end 132 extending along central axis CA and connected to panel wall 136 of second end 132. A plurality of bolt heads 139 extends along the central axis CA, and are configured to abut inner face 126 to connect the combustor panel 120 to the outer skin 116. Plurality of bolt heads 139 may be T-head bolt heads or flanged head configured to enter key hole slot. These embodiments will be discussed in detail in FIGS. 3A-B with respect to T-head bolt heads, and FIGS. 4A-B with respect to flanged heads. A first plurality of fasteners 140 on outer face 142 of outer skin 116 connects straight body sections 146 of plurality of bolts 138 to outer skin 116. A bolt shoulder 147 varies the diameter of straight body sections 146. The straight body sections 146 of the plurality of bolts 138 pass through outer face 142 of outer skin 116 to inner face 144 of outer skin 116, and through inner face 126 of combustor panel 120. The straight body sections 146 are positioned normal to surfaces 142, 144 of outer skin 116. The combustor panel 120 can be held in place with the plurality of bolts 138 via gravity, fluidic forces from fluid entering first plurality of holes 118 and exiting third plurality of holes 125, a shoulder on the bolts, a Belleville washer type stack between surfaces 126 and 144 to provide a positioning load and allow for thermal expansion, and via other mechanical means such as fasteners 140. The fasteners 140 may be any fasteners suitable for use in a gas turbine engine.

Figure 3B:
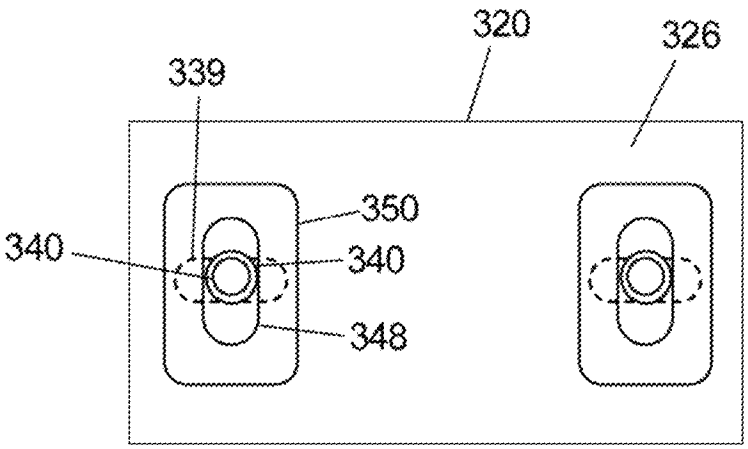
FIG. 3B is a top view of a gas turbine engine combustor panel assembly with T-head bolts at a locking position.
Figure 3A:
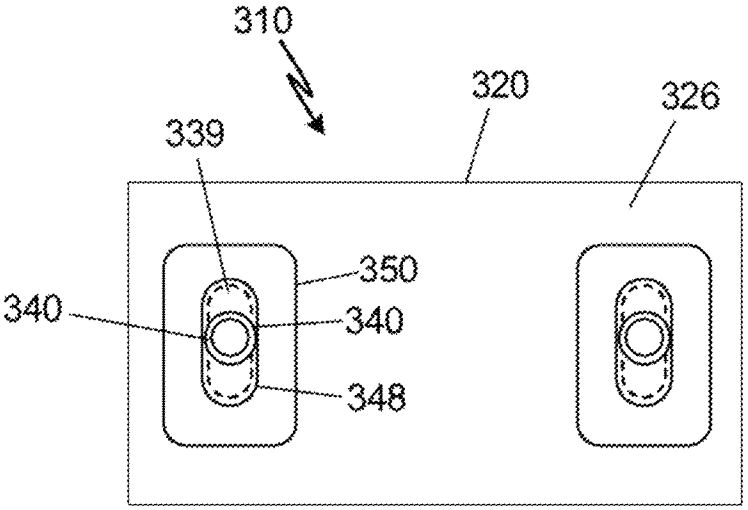
FIG. 3A is a top view of a gas turbine engine combustor panel assembly with T-head bolts at an insertion position.

FIG. 3A is a top view of a gas turbine engine combustor panel assembly with T-head bolts at an insertion position. FIG. 3B is a top view of a gas turbine engine combustor panel assembly with T-head bolts at a locking position. FIGS. 3A-B will be discussed together.

As viewed, inner face 326 of combustor panel 320 can be seen, with outer skin not pictured. FIGS. 3A-B shows part of assembly 310 with combustor panel 320, plurality of T-head bolt heads 339, plurality of fasteners 340, plurality of bolt slots 348, and plurality of sheet metal seal plates 350.

In FIG. 3A, plurality of T-head bolt heads 339 are oriented parallel to plurality of bolt slots 348. Plurality of T-head bolt heads 339 are slightly smaller than plurality of bolt slots 348, and fit within. FIG. 3B shows plurality of T-head bolt heads 339 rotated to be oriented perpendicular to plurality of bolt slots 348. This orientation caused the plurality of T-head bolt heads 339 to remain within inner face of combustor panel 320. Plurality of fasteners 340 and plurality of T-head bolt heads 339, interfacing with inner face 326, hold combustor panel 320 to outer skin. Plurality of sheet metal seal plates 350 help seal fluid from passing through any gaps between bolts and bolt slots, circumventing any plurality of holes 124 (not pictured).

Figure 4B:
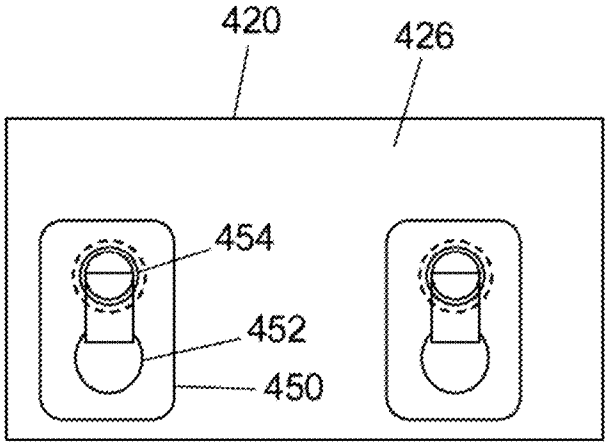
FIG. 4B is a top view of a gas turbine engine combustor panel assembly with flanged bushings and key-hole slots at a locking position.
Figure 4A:
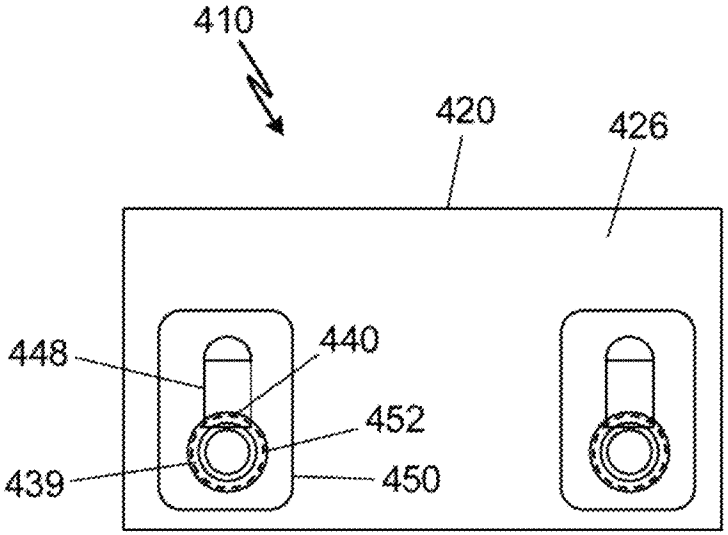
FIG. 4A is a top view of a gas turbine engine combustor panel assembly with flanged bushings and key-hole slots at an insertion position.

FIG. 4A is a top view of a gas turbine engine combustor panel assembly with flanged bushings and key-hole slots at an insertion position. FIG. 4B is a top view of a gas turbine engine combustor panel assembly with flanged bushings and key-hole slots at a locking position. FIGS. 4A-B will be discussed together.

As viewed, inner face 426 of combustor panel 420 can be seen, with outer skin not pictured. FIGS. 4A-B shows part of assembly 410 with combustor panel 420, plurality of flanged bushing heads 439, plurality of fasteners 440, plurality of bolt slots 448, and plurality of sheet metal seal plates 450.

In FIG. 4A, plurality of flanged bushing heads 439 located at a plurality of key hole slots 452 prior to sliding into position in plurality of bolt slots 448. Plurality of flanged bushing heads 439 are slightly smaller than plurality of key hole slots 452, and fit within. FIG. 3B shows plurality of flanged bushing heads 439 at a locked slot 454 position of plurality of bolt slots 448. At this position, the plurality of flanged bushing heads 439 are larger that plurality of bolt slots 448, and causes plurality of flanged bushing heads 439 to remain within inner face of combustor panel 420. Plurality of fasteners 440 hold plurality of flanged bushing heads 439 to inner face 426 to hold combustor panel 420 to outer skin. Plurality of sheet metal seal plates 450 help seal fluid from passing through any gaps between bushings and bolt slots, circumventing any plurality of holes 124 (not pictured).

The proposed attachment configurations as disclosed above will allow combustor panels to be made of a variety of high temperature materials including nickel superalloys, including single crystal nickel superalloys, and ceramic matrix composites (CMCs). Combustor panel 120, 320, 420, and outer skin 116 may be constructed from or otherwise include a ceramic material such as, but not limited to, a ceramic matrix composite (CMC) material. The CMC material includes ceramic fibers that are disposed in a ceramic matrix. The CMC material may be, but is not limited to, a SiC/SiC composite in which silicon carbide (SiC) fibers are disposed within a silicon carbide (SiC) matrix. The ceramic fibers are provided in fiber plies that may be woven or braided and may collectively include plies of different fiber weave configurations. Combustor panel 120, 320, 420, shell 112, and/or plurality of bolts 138, may be constructed from or otherwise include metals and other non-ceramic material, Examples of suitable metals include, but are not limited to, cobalt superalloys, such as Haynes 25 and Haynes 188, and nickel superalloys such as Inconel 625, Inconel 718, and single crystal nickel superalloys.

Any of the above embodiments may be used to cover entire outer skin 116, of shell 112, with combustor panels 120, 320, 420. Combustor panels 120, 320, 420 can abut up to each other to form an annulus completely shielding shell 112 of outer skin 116, from gases in combustion chamber 114.

It is understood that any of the plurality of holes can be formed at various angles deemed appropriate for a particular application to cause fluid to enter at different angles. This helps prevent debris from accumulating within the plurality of holes 118, 124, 125 or within the inner void 130 of the combustor panels. In some embodiments, raised elements also help collect debris from entering the second plurality of holes 124 to prevent oxidation of internal combustion chamber section 134. Inner face outer skin 116, inner face 126, and outer face 128 provide 3 layers for dirt rejection/compartmentalization between the outer skin and the internal combustion chamber section of the combustor panel.

A bolted attachment assembly as disclosed eliminates typical combustor panel studs, thus eliminating the distress and failure modes associated with the hot spots in the region around combustor panel studs.

Discussion of Possible Embodiments

The following are non-exclusive descriptions of possible embodiments of the present invention.

A gas turbine engine combustor panel assembly includes a shell defining an outer periphery of a combustion chamber, the shell having an outer skin with a first plurality of holes. The assembly further includes a combustor panel including a first end including a second plurality of holes on an inner face of the combustor panel extending through the inner face to an inner void then to an outer face of the combustor panel with a third plurality of holes configured to allow fluid flow from the first plurality of holes to the combustion chamber, a plurality of bolt holes, and a second end comprising an internal combustion chamber section extending axially from a central axis and from a panel wall of the combustor panel. The assembly includes a sheet metal seal plate abutting the plurality of bolt holes and the interface of the combustor panel, and a plurality of bolts configured to extend along a central axis and interface with the plurality of bolt holes to connect the combustor panel to the shell.

The assembly of the preceding paragraph can optionally include, additionally and/or alternatively, any one or more of the following features, configurations and/or additional components:

The plurality of bolts can be T-head bolts and further include a T-head bolt head and a bolt body, and the plurality of bolt holes can be oblong and configured to fit the T-head bolt head in a first orientation.

The plurality of bolts can be flanged bushings further comprising a flanged head, a bolt shoulder, and a bolt body, and the plurality of bolt holes further include a key hole end larger than the flanged head, and a locking end smaller than the flanged head.

The assembly can further include raised elements on the inner face of the combustor panel configured to trap debris from fluid flow entering the second plurality of holes.

The combustor panel can be made of a densified, laminated ceramic matric composite (CMC) material.

The CMC material of the preceding paragraph can be composed of silicon carbide (SiC) fiber plies and a silicon carbide (SiC) matrix.

The combustor panel can be actively cooled.

The second plurality of holes can be oriented at an angle from the inner face of the combustor panel.

The assembly can further include raised elements on the inner face of the combustor panel and oriented at an angle from the inner face of the combustor panel.

The combustor panel can have an inner void area configured to provide an air gap between the inner face and outer face of the combustor panel.

The first plurality of holes can be oriented at an angle from an inner face of the outer skin.

The assembly can further include cooling fluid that is configured to be directed into the first plurality of holes.

In another embodiment, a combustor panel arrangement for use in a combustor in a gas turbine engine includes a shell defining a combustion chamber, the shell having an outer skin with a first plurality of holes. The arrangement further includes a first combustor panel with a first end including a second plurality of holes on an inner face of the first combustor panel through to an inner void then to an outer face of the first combustor panel and configured to allow fluid flow from the first plurality of holes to the combustion chamber. The first combustor panel further includes a first plurality of bolt holes, and a second end comprising an internal combustion chamber section extending axially from a central axis and from a panel wall of the combustor panel. The assembly further includes second combustor panel with a first end including a second plurality of holes on an inner face of the second combustor panel through to an inner void then to an outer face of the second combustor panel and configured to allow fluid flow from the first plurality of holes to the combustion chamber. The second combustor panel further includes a second plurality of bolt holes, and a second end comprising an internal combustion chamber section extending axially from a central axis and from a panel wall of the combustor panel. The arrangement further includes a first plurality of bolts configured to extend along a central axis and interface with the first plurality of bolt holes of the to connect the first combustor panel to the shell, and a second plurality of bolts configured to extend along a central axis and interface with the second plurality of bolt holes of the to connect the second combustor panel to the shell, wherein the panel wall of the first combustor panel and the panel wall of the second combustor panel abut to each other.

The arrangement of the preceding paragraph can optionally include, additionally and/or alternatively, any one or more of the following features, configurations and/or additional components:

The combustor panels can be made of a densified laminated ceramic matric composite (CMC) material.

The CMC material of the preceding paragraph can be composed of silicon carbide (SiC) fiber plies and a silicon carbide (SiC) matrix.

The combustor panels can be actively cooled.

The second plurality of holes of at least one of the combustor panels can be oriented at an angle from the inner face of the combustor panel.

At least one of the combustor panels can have an inner void area configured to provide an air gap between the inner face and outer face of the combustor panels.

The first plurality of holes of at least one of the combustor panels can be oriented at an angle from an inner face of the outer skin.

The assembly can further include cooling fluid configured to be directed into the first plurality of holes of at least one of the combustor panels.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A gas turbine engine combustor panel assembly comprising:

a shell defining an outer periphery of a combustion chamber, the shell having an outer skin with a first plurality of holes;

a combustor panel, the combustor panel comprising:

a first end including a second plurality of holes on an inner face of the combustor panel extending through the inner face to an inner void then to an outer face of the combustor panel with a third plurality of holes configured to allow fluid flow from the first plurality of holes to the combustion chamber, and a plurality of bolt holes, wherein the inner void is a space defined by the inner face of the combustor panel, the outer face of the combustor panel and a plurality of bolts;

a second end comprising an internal combustion chamber section extending axially from a central axis and from a panel wall of the combustor panel;

a sheet metal seal plate abutting the plurality of bolt holes and an interface of the combustor panel; and the plurality of bolts configured to extend along a central axis and interface with the plurality of bolt holes to connect the combustor panel to the shell.

2. The gas turbine engine combustor panel assembly of claim 1, wherein the plurality of bolts are T-head bolts further comprising a T-head bolt head and a bolt body, and the plurality of bolt holes are oblong and configured to fit the T-head bolt head in a first orientation.

3. The gas turbine engine combustor panel assembly of claim 1, wherein the plurality of bolts are flanged bushings further comprising a flanged head, a bolt shoulder, and a bolt body, and the plurality of bolt holes further comprise a key hole end larger than the flanged head, and a locking end smaller than the flanged head.

4. The gas turbine engine combustor panel assembly of claim 1, further comprising raised elements on the inner face of the combustor panel configured to trap debris from fluid flow entering the second plurality of holes.

5. The gas turbine engine combustor panel assembly of claim 1, wherein the combustor panel is made of a densified, laminated ceramic matrix composite (CMC) material.

6. The gas turbine engine combustor panel assembly of claim 5, wherein the densified, laminated ceramic matrix composite material is composed of silicon carbide (SiC) fiber plies and a silicon carbide (SiC) matrix.

7. The gas turbine engine combustor panel assembly of claim 1, wherein the combustor panel is actively cooled.

8. The gas turbine engine combustor panel assembly of claim 1, wherein the second plurality of holes are oriented at an angle from the inner face of the combustor panel.

9. The gas turbine engine combustor panel assembly of claim 8, further comprising raised elements on the inner face of the combustor panel and oriented at an angle from the inner face of the combustor panel.

10. The gas turbine engine combustor panel assembly of claim 1, wherein an area of the inner void is configured to provide an air gap between the inner face and outer face of the combustor panel.

11. The gas turbine engine combustor panel assembly of claim 1, wherein the first plurality of holes are oriented at an angle from an inner face of the outer skin.

12. The gas turbine engine combustor panel assembly of claim 1, wherein cooling fluid is configured to be directed into the first plurality of holes.

13. A combustor panel arrangement for use in a combustor in a gas turbine engine, comprising:

a shell defining a combustion chamber, the shell having an outer skin with a first plurality of holes and further comprising:

a first combustor panel with a first end including a second plurality of holes on an inner face of the first combustor panel through to a first inner void then to an outer face of the first combustor panel, and configured to allow fluid flow from the first plurality of holes to the combustion chamber, a first plurality of bolt holes, and a second end comprising an internal combustion chamber section extending axially from a central axis and from a panel wall of the combustor panel, wherein the first inner void is a space defined by the inner face of the first combustor panel, the outer face of the first combustor panel and a first plurality of bolts;

a second combustor panel with a first end including a second plurality of holes on an inner face of the second combustor panel through to a second inner void then to an outer face of the second combustor panel, and configured to allow fluid flow from the first plurality of holes to the combustion chamber, a second plurality of bolt holes, and a second end comprising an internal combustion chamber section extending axially from a central axis and from a panel wall of the combustor panel, wherein the second inner void is a space defined by the inner face of the second combustor panel, the outer face of the second combustor panel and a second plurality of bolts;

the first plurality of bolts configured to extend along a central axis and interface with the first plurality of bolt holes to connect the first combustor panel to the shell;

a sheet metal seal plate abutting the plurality of bolt holes and an interface of at least one of the combustor panels; and the second plurality of bolts configured to extend along a central axis and interface with the second plurality of bolt holes to connect the second combustor panel to the shell, wherein the panel wall of the first combustor panel and the panel wall of the second combustor panel abut to each other.

14. The combustor panel arrangement of claim 13, wherein at least one of the combustor panels is made of a densified laminated ceramic matrix composite (CMC) material.

15. The combustor panel arrangement of claim 14, wherein the densified, laminated ceramic matrix composite material is composed of silicon carbide (SiC) fiber plies and a silicon carbide (SiC) matrix.

16. The combustor panel arrangement of claim 13, wherein at least one of the combustor panels is actively cooled.

17. The combustor panel arrangement of claim 13, wherein the second plurality of holes of at least one of the combustor panels are oriented at an angle from the inner face of the combustor panel.

18. The combustor panel arrangement of claim 13, wherein an area of the first inner void and an area of the second inner void are configured to provide an air gap between the inner face and outer face of the combustor panels that define the first inner void area and the second inner void area, respectively.

19. The combustor panel arrangement of claim 13, wherein the second plurality of holes on the inner face of at least one of the combustor panels are oriented at an angle from an inner face of the outer skin.

20. The combustor panel arrangement of claim 13, wherein cooling fluid is configured to be directed into the second plurality of holes on the inner face of at least one of the combustor panels.

* * * * *